US009214252B2

(12) United States Patent
Watanabe

(10) Patent No.: US 9,214,252 B2
(45) Date of Patent: Dec. 15, 2015

(54) ULTRAFINE CONDUCTOR MATERIAL, ULTRAFINE CONDUCTOR, METHOD FOR PREPARING ULTRAFINE CONDUCTOR, AND ULTRAFINE ELECTRICAL WIRE

(71) Applicant: YAZAKI CORPORATION, Tokyo (JP)

(72) Inventor: Tsuyoshi Watanabe, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/317,690

(22) Filed: Jun. 27, 2014

(65) Prior Publication Data

US 2014/0305679 A1 Oct. 16, 2014

Related U.S. Application Data

(63) Continuation of application No. PCT/JP2012/008323, filed on Dec. 26, 2012.

(30) Foreign Application Priority Data

Dec. 28, 2011 (JP) ..... 2011-288152

(51) Int. Cl.
*H01R 13/03* (2006.01)
*H01R 43/00* (2006.01)
(Continued)

(52) U.S. Cl.
CPC ..... *H01B 1/026* (2013.01); *C22C 9/00* (2013.01); *C22F 1/08* (2013.01); *H01B 7/00* (2013.01); *Y10T 29/49117* (2015.01)

(58) Field of Classification Search
CPC ..... C22C 9/00; C22F 1/08; H01B 1/026; H01B 7/00
USPC ..... 174/94 R, 110 R; 29/825; 420/470
See application file for complete search history.

(56) References Cited

U.S. PATENT DOCUMENTS 4,439,247 A * 3/1984 Arita ..... C22F 1/08 148/554
4,755,235 A * 7/1988 Matidori ..... C22C 9/00 148/411

(Continued)

FOREIGN PATENT DOCUMENTS

EP 0 779 372 A1 6/1997
JP 59-89742 A 5/1984
JP 2001-295011 A 10/2001

OTHER PUBLICATIONS

International Search Report and Written Opinion of the International Search Report for PCT/JP2012/008323 dated Jun. 6, 2013.

*Primary Examiner* — Timothy Thompson
*Assistant Examiner* — Rhadames J Alonzo Miller
(74) *Attorney, Agent, or Firm* — Kenealy Vaidya LLP

(57) ABSTRACT

[Technical Problem] The invention is to provide a method for manufacture of an ultrafine conductor having sufficient electrical conductivity, and enhanced strength and stretch properties while suppressing manufacture cost, the same ultrafine conductor, as well as a material suited for the same ultrafine conductor. [Solution to Problem] To solve the above problem, there is provided a material for an ultrafine conductor, which includes a matrix formed of copper, chromium particles contained in the matrix, and tin contained in the matrix. The tin is present as a solid solution in the matrix.

6 Claims, 3 Drawing Sheets

(51) Int. Cl.

| | |
|---|---|
| ***C22C 9/02*** | (2006.01) |
| ***H01B 1/02*** | (2006.01) |
| ***C22C 9/00*** | (2006.01) |
| ***C22F 1/08*** | (2006.01) |
| ***H01B 7/00*** | (2006.01) |

(56) References Cited

U.S. PATENT DOCUMENTS 4,915,903 A * 4/1990 Brupbacher ..... C22C 32/00 148/328
5,093,148 A * 3/1992 Christodoulou ..... B22F 3/23 219/118
5,106,701 A * 4/1992 Kurosaka ..... C22F 1/08 148/432
5,240,520 A * 8/1993 Tarui ..... C21D 7/06 148/532
5,252,147 A * 10/1993 Verhoeven ..... C23C 26/02 148/237
5,312,495 A * 5/1994 Masumoto ..... C22F 1/00 148/403
5,370,840 A * 12/1994 Caron ..... C22F 1/08 420/485
5,702,542 A * 12/1997 Brown ..... B22D 19/14 148/326
6,063,217 A * 5/2000 Saleh ..... C22C 9/00 148/682
2002/0066503 A1* 6/2002 Matsui ..... C22F 1/08 148/432
2002/0195427 A1* 12/2002 Miyoshi ..... B23H 7/08 219/69.12
2003/0188814 A1* 10/2003 Fukamachi ..... C22F 1/08 148/684
2004/0005773 A1* 1/2004 Lopatin ..... H01L 21/288 438/622
2004/0154925 A1* 8/2004 Podlaha ..... C25D 15/02 205/104
2004/0187977 A1* 9/2004 Matsui ..... C22F 1/08 148/553
2004/0213692 A1* 10/2004 Ishijima ..... B22F 1/0003 419/32
2005/0011591 A1* 1/2005 Murty ..... B22F 9/082 148/400
2007/0187134 A1* 8/2007 Detian ..... C22F 1/08 174/126.1
2007/0254180 A1* 11/2007 Ababneh ..... B32B 15/015 428/677
2008/0181811 A1* 7/2008 Mihara ..... C22C 9/00 420/476
2009/0053090 A1* 2/2009 Terao ..... H01L 23/3736 419/29
2009/0151824 A1* 6/2009 Yamasaki ..... C21D 8/065 148/598
2009/0183803 A1* 7/2009 Mutschler ..... C22F 1/08 148/554
2009/0229711 A1* 9/2009 Yamasaki ..... C21D 8/065 148/505
2010/0170595 A1* 7/2010 Kaneko ..... C22C 9/00 148/554
2012/0027638 A1* 2/2012 Kosaka ..... C22F 1/08 420/471
2013/0028784 A1* 1/2013 Takahashi ..... C22C 9/06 420/471
2013/0092437 A1* 4/2013 Yoshinaga ..... C22C 9/00 174/75 R

* cited by examiner

ULTRAFINE CONDUCTOR MATERIAL, ULTRAFINE CONDUCTOR, METHOD FOR PREPARING ULTRAFINE CONDUCTOR, AND ULTRAFINE ELECTRICAL WIRE

TECHNICAL FIELD

The invention relates to ultrafine conductor having an enhanced strength, a method for preparing the same ultrafine conductor, and a material for the same ultrafine conductor.

Ultrafine conductors having a thickness of equal to or less than 0.2 mm are generally used for electronic devices, IC testers, medical devices, and vehicle wiring harnesses in which minimization has been particularly needed. However, in the afore-mentioned fields, the ultrafine conductor is required to satisfy conductivity, strength, and stretch requirements.

In relation to the above technologies, JP 2001-295011 (A) discloses an ultrafine conductor having tensile strength of 450 Mpa, stretch of equal to or greater than 4%, and electrical conductivity of greater than 50% IACS, which is prepared by adding silver, niobium, ferrous, or chromium to a matrix material, copper, and being subjected to casting, wire drawing, and heat treatment.

However, in accordance with the above conventional technologies the strength attained via the wire drawing may be lowered by the subsequent heat treatment, as the heat treatment is carried out for the purpose of improving or enhancing stretch properties.

In this connection, the effect of the heat treatment after wire drawing on tensile strength is shown in FIGS. 3A and 3B. FIG. 3A is a graph showing the effect of the temperature of the heat treatment on tensile strength and stretch properties. FIG. 3B is a graph showing the temperature of the heat treatment on electrical conductivity properties.

As shown in FIGS. 3A and 3B, it can be understood that the stretch and electrical conductivity properties are enhanced but the tensile strength properties are lowered, as the temperature of the heat treatment is increased.

Furthermore, the above conventional technologies are cost-consuming job, as each of the elements should be added at a relatively high concentration (for example, in an amount of from 10 to 15% by weight for the purpose of attaining sufficient strength).

CITATION LIST

Patent Literature

[PTL 1]
JP 2001-295011 A

SUMMARY OF INVENTION

Technical Problem

The invention is provided in order to overcome the above problems or drawbacks. In other words, the invention is to provide a method for manufacture of an ultrafine conductor having sufficient electrical conductivity, and enhanced strength and stretch properties while suppressing manufacture cost, the same ultrafine conductor, as well as a material suited for the same ultrafine conductor.

Solution to Problem

In order to solve the above drawbacks and problems, there is provided a material for an ultrafine conductor, which includes matrix formed of copper, chromium particles contained in the matrix, and tin contained in the matrix. The tin is present as a solid solution in the matrix.

The chromium is preferably present in an amount of from 3 at % to 5 at %. An amount of the chromium and an amount of the tin are determined to satisfy the following formula 1 given that the amount of the chromium is X at % and the amount of the tin is Y at %. In this regard, an amount of the copper is determined by subtracting sum of X at % and Y at % from 100 at %. In other words, the copper is added as a balance (a remainder).

[Formula 1]

$$0.15 \leq Y \leq 0.6 - 0.15(X-3) \quad \text{(I)}$$

In another aspect of the invention, there is provided an ultrafine conductor formed of material as mentioned previously, which includes a short fibrous portion formed of chromium, and a matrix having a local change generated over the entire matrix.

In the ultrafine conductor, aspect ratio of the short fibrous portion formed of chromium is preferably from 0.05 to 0.8.

In a further aspect of the invention, there is provided a method for preparing an ultrafine conductor, which includes the step of stretching material as mentioned previously until a local change is generated over the entire matrix.

In a further aspect of the invention, there is provided an ultrafine electrical wire, which includes a conductor portion obtained by stranding an ultrafine conductor as mentioned previously, and an insulating covering disposed over the conductor.

Advantageous Effects of Invention

In accordance with the invention, the material for ultrafine conductor allows for the manufacture of the ultrafine conductor having favorable electrical conductivities, tensile strength, and stretch properties at a relatively low cost.

In accordance with the invention, the ultrafine conductor can be manufactured at a relatively low cost while maintaining favorable electrical conductivities, tensile strength, and stretch properties.

In accordance with the invention, there is provided a method for preparing an ultrafine conductor having sufficient electrical conductivity, tensile strength and stretch properties in a relatively low cost.

In accordance with the invention, the ultrafine conductor can be advantageously used for an electrical wire suited for a vehicle wiring harness.

BRIEF DESCRIPTION OF DRAWINGS

FIG. 1A is a map of electron backscatter diffraction (EBSD) for a cross section taken in a stretching direction of the ultrafine conductor in accordance with the invention.

FIG. 1B is provided for illustrating FIG. 1A.

FIG. 2 is a graph showing the relationship between equivalent distortion (or equivalent strain) and stretch as an ultrafine conductor material of Example 2 is drawn.

FIG. 3A is a graph showing the effect of heating temperature applied to conventional ultrafine conductor material on tensile strength and stretch properties.

FIG. 3B is a graph showing the effect of heating temperature applied to conventional ultrafine conductor material on electrical conductivity properties.

DESCRIPTION OF EMBODIMENTS

Material suitable for an ultrafine conductor in accordance with the invention includes a matrix consisted of copper, and chromium particles contained in the matrix. In the matrix, tin is present in the form of solid solution. More specifically, tin forms a solid solution in copper, but does not form a solid solution in chromium.

Such ultrafine conductor material can be prepared by blending chromium, copper, and tin, and subsequently casing the blend as obtained.

Generally, wire drawing causes distortion or strain to accumulate, thereby enhancing the strength of the material. On the contrary, the accumulated distortion or strain only allows deformation to a certain extent. As a result, stretch is restricted.

In accordance with one embodiment of the invention, the matrix can be reinforced by adding tin, which is an element capable of forming solid solution with the matrix, to the matrix. In this regard, the matrix means a portion other than the chromium particles, which forms short fibrous portion when it is subjected to stretching or drawing.

In a case where the matrix reinforced as such is subjected to drawing or stretching, when area reduction rate increases beyond a certain level, a local change at the micro level (i.e., "micro-level local change") is generated in the matrix, thereby ultimately resulting in local change at the micro level (i.e., micro-level local change) over the entire matrix texture.

When tensile stress is applied to the conductor in which the matrix has undergone such micro-level local change, the conductor can obtain additional stretch in accordance with the local change.

In accordance with the invention, a term "micro-level local change" as used herein means deformation accompanied by local rotation of the crystal of the matrix in a stretching direction, as the matrix or material is subjected to drawing or stretching treatment. In accordance with a map of electron backscatter diffraction (EBSD), the local change can be represented as gray color with a color gradient from light gray to dark gray. On the other hand, short fibrous portion consisted of chromium is represented as black color.

Figure 1A:
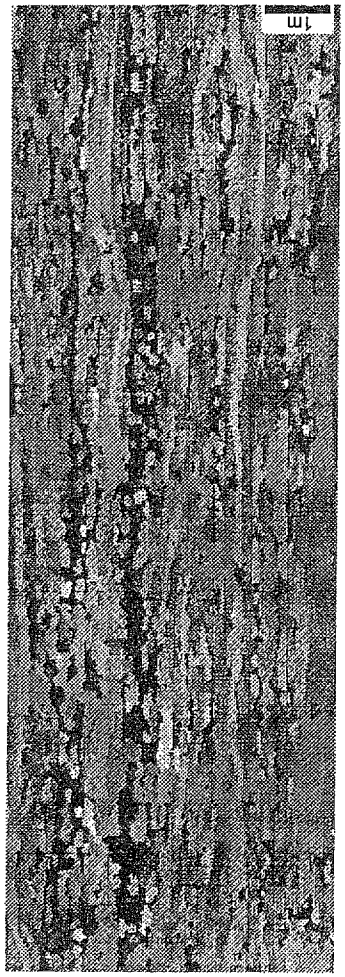
[FIG. 1A]

FIG. 1A is a map of electron backscatter diffraction (EBSD) for a cross section of the ultrafine conductor, parallel to the stretching direction. In this regard, the ultrafine conductor is obtained by stretching or drawing the ultrafine conductor material of Example 3, which will be described below, such that the area reduction rate reaches 99.9%.

Figure 1B:
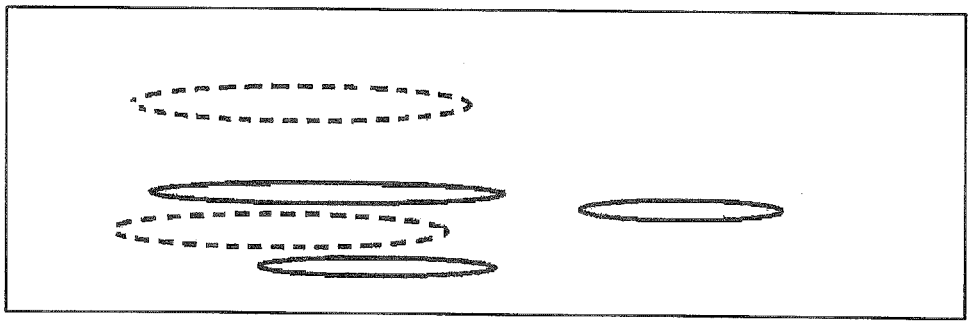
[FIG. 1B]

The micro-level local change can be remarkably observed in the part of FIG. 1A corresponding to the elliptical portion which is encircled by a dotted line in FIG. 1B. Furthermore, the short fibrous portion consisted of chromium can be remarkably observed in the part of FIG. 1A corresponding to the elliptical portion which is encircled by a solid line in FIG. 1B.

Due to such local change in the matrix, the ultrafine conductor in accordance with the invention can attain sufficient level or amount of stretch.

Surprisingly, in a case where tin is replaced with phosphorous which is a known element capable of reinforcing copper matrix, and enhancing strength or intensity during processing, the afore-mentioned micro-level local change is never generated. As a result, the conductor cannot achieve sufficient stretch. This is because phosphorus, which is added to copper-chromium system, does not form a solid solution in the matrix (i.e., copper), but forms a solid solution in chromium.

As such, in accordance with the invention, tin which can be dissolved in the copper-based matrix but cannot be dissolved in chromium is needed.

In accordance with the invention, it is preferable to employ chromium in a content (amount) of from 3 at % to 5 at %, and satisfy the following formula (I) given that the content of chromium is X at % and the content of tin is Y at %. The balance (a remainder) will be copper. The above composition is desired in terms of favorable electrical conductivities, tensile strength, and stretch properties. In this connection, favorable electrical conductivities may be equal to or greater than 45% IACS which corresponds to electrical resistance value required for the ultrafine conductor having the thickness of 0.2 mm or below in the field of vehicle wring harness; favorable tensile strength may be equal to or greater than 900 MPa which corresponds to strength value required for the ultrafine conductor having the thickness of 0.2 mm or below in the field of vehicle wiring harness; and favorable stretch properties may be equal to greater than 4% which corresponds to stretch value required for the ultrafine conductor having the thickness of 0.2 mm or below in the field of vehicle wiring harness.

[Formula 2]

$$0.15 \leq Y \leq 0.6 - 0.15(X-3) \quad \text{(I)}$$

In a case where the content of chromium is less than 3 at %, the matrix-reinforcing effect achieved by the short fibrous portion formed of chromium after drawing or stretching process would not be enough. On the contrary, in a case where the content of chromium is greater than 5 at %, due to breakage during wire drawing process ultrafine conductor is difficult to ultimately obtain. Furthermore, in a case where the content of tin is less than the above range, the matrix-reinforcing effect achieved by tin due to the formation of solid solution would not be enough, thereby failing to generate sufficient amount of micro-level local change. As a result, the conductor after stretch processing cannot achieve sufficient level or amount of stretch. On the contrary, in a case where the content of tin is greater than the above range, favorable level of electrical conductivity cannot be obtained.

In accordance with the invention, aspect ratio can be determined by using a map of electron backscatter diffraction (EBSD) for a cross section of a sample ultrafine conductor taken in its longitudinal direction. The aspect ratio of the short fibrous portion formed of chromium as observed can be defined by a length in a direction perpendicular to the longitudinal direction (i.e., a width "D") divided by a length in the longitudinal direction ("L"), and advantageously falls between 0.05 and 0.8 in accordance with the invention. if the above range is satisfied, the characteristic effects of the inventive ultrafine conductor can be obtained.

In a case where the content of tin is less than the range as represented by the formula (I), it is hard to achieve sufficient level of tensile strength. On the contrary, in a case where the content of tin is greater than the range as represented by the formula (I), it is hard to satisfy the given electrical conductivities, and breakage readily occurs during wire drawing process.

The ultrafine conductor material (i.e., the material for ultrafine conductor) in accordance with the invention as obtained by casting is subjected to stretching or drawing in accordance with a general method for manufacturing an electrical wire. In this situation, the ultrafine conductor material is subjected to stretching or drawing process until the aforementioned micro-level local change is generated over the entire matrix. Generally, when area reduction rate reaches 99.3% or above, the micro-level local change is generated over the entire matrix. It is desired in that area reduction rate of 99.9% or above can attain more deliberate local change.

EXAMPLE

Figure 2:
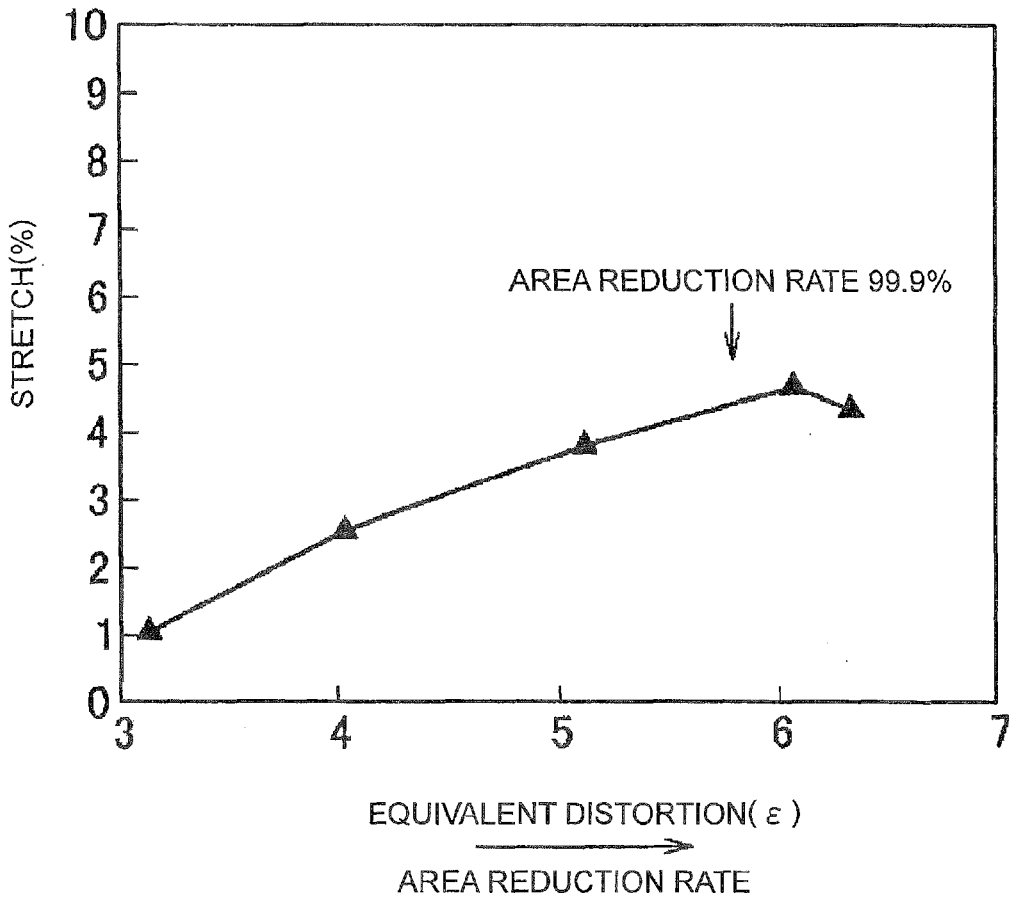
[FIG. 2]
Figure 3A:
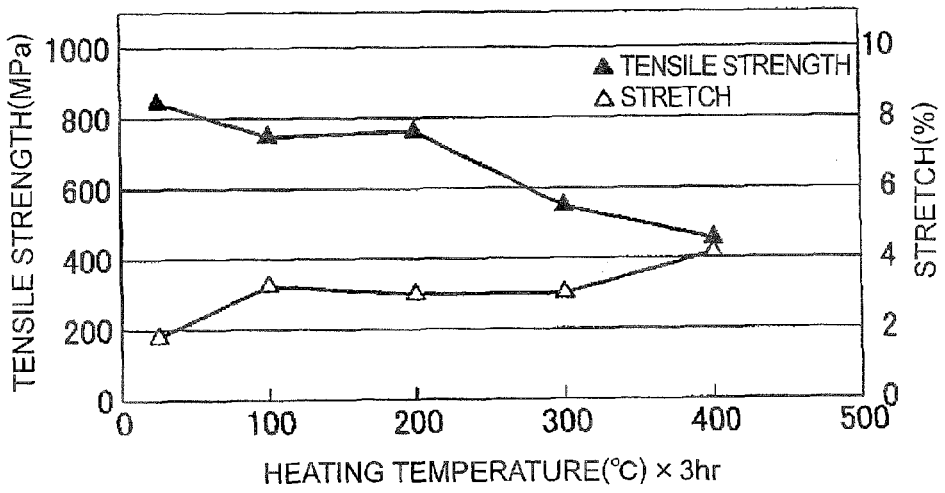
[FIG. 3A]
Figure 3B:
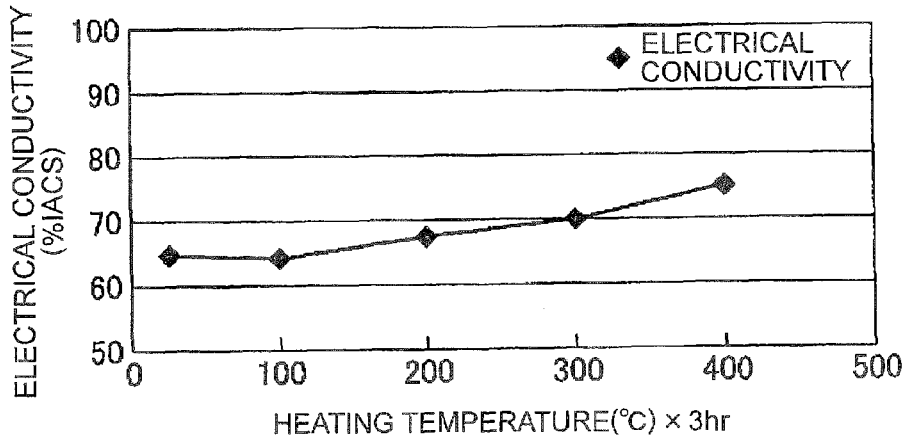
[FIG. 3B]

The invention will be described in detail with reference to examples of ultrafine conductor. Raw materials were provided in accordance with Table 1. In this regard, the content of copper was determined by subtracting the sum of the content of chromium and the content of tin from 100 at %. The raw materials were subjected to casting, and then wire drawing processing to obtain a crude wire having a diameter of 5 mm. The crude wire thus obtained was subjected to heat treatment at 800 Celsius degrees for a period of 1 hour. The crude wire was further subjected to wire drawing treatment until that area reduction rate reached 99.9%. As a result, ultrafine conductors having a diameter of 0.18 mm were obtained. For reference, equivalent distortion (or equivalent strain) as shown in FIG. 2 can be defined by a logarithm of the diameter of the wire before wire drawing divided by the diameter of the wire after wire drawing. It is noted that the sample broken during wire drawing treatment, which was considered to be hard to manufacture an ultrafine conductor therefrom, was excluded from observation and evaluation.

or above, the sample is evaluated to have sufficient performance as an ultrafine conductor suited for a vehicle wiring harness.

Furthermore, electrical conductivities were measured by a four-terminal method. In this regard, in a case where electrical conductivities (rate) is 45% IACS or above, the corresponding sample is evaluated to satisfy the performance required for an ultrafine conductor having the thickness of 0.2 mm or below in the field of vehicle wiring harness.

In addition, stretch properties of an electrical wire were investigated. Specifically, each sample electrical wire was prepared by providing a stranded wire formed of three ultrafine conductors, and subjecting the stranded wire to polypropylene resin extrusion molding to obtain an insulated electrical wire having an outer diameter of 0.55 mm. it is understood that this insulated electrical wire can be used as an ultrafine electrical wire suited for a vehicle wiring harness. The stretch of the insulated electrical wire as thus obtained was measured.

The results are summarized in Table 1 as listed above. The results summarized in Table 1 shows that the examples of the ultrafine conductor in accordance with the invention satisfy the strength, stretch, and electrical conductivity properties as required for the ultrafine conductor having the thickness of 0.2 mm or below in the field of vehicle wiring harness.

TABLE 1

| | content (at %) | | tensile strength | Stretch of element wire | conductivity | portion composed of chromium | | matrix portion | | stretch of insulated wire |
|---|---|---|---|---|---|---|---|---|---|---|
| | chromium | tin | (MPa) | (%) | (% IACS) | average size (μm) | aspect ratio | average size (μm) | aspect ratio | (%) |
| Ex. 1 | 3 | 0.6 | 1070 | 3.8 | 38 | 0.19 | 0.05~0.7 | 0.14 | 0.025~0.8 | |
| Ex. 2 | 5 | 0.16 | 900 | 5 | 54 | 0.19 | 0.05~0.7 | 0.22 | 0.025~0.8 | 8 |
| Ex. 3 | 5 | 0.3 | 1006 | 4 | 42 | 0.19 | 0.05~0.7 | 0.17 | 0.025~0.8 | 7 |
| Com. Ex. 1 | 7.5 | 0.3 | 1100 | 3 | 35 | 0.19 | 0.05~0.7 | 0.13 | 0.025~0.8 | 8 |
| Com. Ex. 2 | 10 | 0.3 | not subjected to observation and evaluation due to breakage during drawing | | | | | | | — |
| Com. Ex. 3 | 1.8 | — | 830 | 2 | 75 | 0.2 | 0.05~0.6 | 0.22 | 0.025~0.8 | |
| Com. Ex. 4 | 3 | — | 820 | 3 | 64 | 0.2 | 0.05~0.6 | 0.22 | 0.025~0.8 | |
| Com. Ex. 5 | 5 | — | 870 | 5 | 53 | 0.2 | 0.05~0.6 | 0.19 | 0.025~0.8 | 8 |
| Com. Ex. 6 | 7 | — | not subjected to observation and evaluation due to breakage during drawing | | | | | | | — |
| Com. Ex. 7 | 10 | — | not subjected to observation and evaluation due to breakage during drawing | | | | | | | — |
| Com. Ex. 8 | 15 | — | not subjected to observation and evaluation due to breakage during drawing | | | | | | | — |
| Com. Ex. 9 | — | 0.15 | 695 | 2.9 | 76 | — | — | 0.26 | 0.025~0.8 | 3 |
| Com. Ex. 10 | — | 0.3 | 778 | 2.8 | 64 | — | — | 0.20 | 0.025~0.8 | |
| Com. Ex. 11 | — | 0.5 | 854 | 3 | 53 | — | — | 0.16 | 0.025~0.8 | |

The ultrafine conductors as thus obtained were observed and evaluated. Firstly, a map of electron backscatter diffraction (EBSD) for a cross section of a sample ultrafine conductor taken in its longitudinal direction was provided. The shapes of the short fibrous portion formed of chromium and the particulate matrix portion were observed, and an average size (i.e., a length of conductor in its longitudinal direction) and aspect ratio were measured for both of short fibrous portion and matrix portion.

Tensile strength and stretch tests were carried out by using a material tester obtained from Instron Corporation. In a case where tensile strength is 900 MPa or above, and stretch is 4%

Furthermore, it can be understood that an element wire having stretch of from 3.8% to 5% results in an insulated electrical wire having stretch of from 7% to 10% in view of Table 1. In a case where an insulated electrical wire has stretch of 7% or above, it is considered to satisfy stretch properties required for the field of vehicle wiring harness.

In all of the ultrafine conductors of Examples 1-3, the micro-level local change was observed over the entire matrix. However, in the case of the ultrafine conductors of the comparative examples, there was not observed such micro-level local change over the entire matrix.

FIG. 2 is a graph showing the relationship between equivalent distortion (or equivalent strain) and stretch as a casting formed of the ultrafine conductor material of Example 2 is drawn or stretched.

In accordance with FIG. 2, due to drawing or stretching process equivalent distortion increases. The stretch (%) increases until the equivalent distortion reaches about the value of 6 which corresponds to 99.9% of area reduction rate, but decreases if the equivalent distortion is beyond the value of 6.

The invention claimed is:

1. A material for an ultrafine conductor, comprising a matrix formed of copper, chromium particles contained in the matrix, and tin contained in the matrix, wherein the tin is present as a solid solution in the matrix, wherein the chromium is present in an amount of from 3 at % to 5 at %, wherein an amount of the chromium and an amount of the tin are determined to satisfy the following formula 1:

$$0.15 \leq Y \leq 0.6-0.15(X-3)$$

given that the amount of the chromium is X at % and the amount of the tin is Y at %, and wherein an amount of the copper is determined by subtracting a sum of X at % and Y at % from 100 at %.

2. An ultrafine conductor formed of material as claimed in claim 1, comprising:

a short fibrous portion formed of chromium, and a matrix having a local change generated over the entire matrix.

3. The ultrafine conductor as claimed in claim 2, wherein aspect ratio of the short fibrous portion formed of chromium is from 0.05 to 0.8.

4. A method for preparing an ultrafine conductor, comprising the step of:

stretching material as claimed in claim 1 until a local change is generated over the entire matrix.

5. An ultrafine electrical wire, comprising:

a conductor portion obtained by stranding an ultrafine conductor as claimed in claim 2, and an insulating covering disposed over the conductor portion.

6. An ultrafine electrical wire, comprising:

a conductor portion obtained by stranding an ultrafine conductor as claimed in claim 3, and an insulating covering disposed over the conductor portion.

* * * * *